US008998369B2

(12) United States Patent
Ogawa

(10) Patent No.: US 8,998,369 B2
(45) Date of Patent: Apr. 7, 2015

(54) IMAGE FORMING APPARATUS WITH CONVEYANCE BELT MOVEMENT CORRECTION

(71) Applicant: KYOCERA Document Solutions Inc., Osaka (JP)

(72) Inventor: Masanobu Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 288 days.

(21) Appl. No.: 13/754,599

(22) Filed: Jan. 30, 2013

(65) Prior Publication Data

US 2013/0222456 A1 Aug. 29, 2013

(30) Foreign Application Priority Data

Feb. 28, 2012 (JP) ..... 2012-041380

(51) Int. Cl.

| | |
|---|---|
| ***B41J 29/38*** | (2006.01) |
| ***B41J 13/00*** | (2006.01) |
| ***G03G 13/00*** | (2006.01) |
| ***B41J 11/00*** | (2006.01) |
| ***G03G 15/00*** | (2006.01) |

(52) U.S. Cl.

CPC ..... *B41J 13/0009* (2013.01); *G03G 13/00* (2013.01); *B41J 11/007* (2013.01); *G03G 15/6529* (2013.01); *G03G 2215/00143* (2013.01)

(58) Field of Classification Search

CPC ..... B41J 13/0009; B41J 13/00; G03G 15/14
USPC ..... 347/16
See application file for complete search history.

(56) References Cited

U.S. PATENT DOCUMENTS

2011/0242181 A1 10/2011 Otobe

FOREIGN PATENT DOCUMENTS

| | | | |
|---|---|---|---|
| JP | 62242843 | A | 10/1987 |
| JP | 06117821 | A | 4/1994 |
| JP | 11278708 | A | 10/1999 |
| JP | 2001133550 | A | 5/2001 |
| JP | 2003241474 | A | 8/2003 |
| JP | 2005219848 | A | 8/2005 |
| JP | 2007159894 | A | 6/2007 |
| JP | 2011213450 | A | 10/2011 |

*Primary Examiner* — Alessandro Amari
*Assistant Examiner* — Alexander C Witowski
(74) *Attorney, Agent, or Firm* — Alleman Hall McCoy Russell & Tuttle LLP

(57) ABSTRACT

An image forming apparatus is provided with a conveyance belt, image forming portion, belt moving mechanism, optical sensor, current generation portion, position detection portion, belt movement control unit, reference value storage portion, base current measurement portion, initial value storage portion, and correction value determination portion. The current value measurement portion monitors the decrease in the value of a light receiving signal while decreasing an electric current generated in the current generation portion, and, in the case where the value of the light receiving signal reaches a reference value stored in the reference value storage portion, measures the value of a base current that is generated by the current generation portion. The correction value determination portion determines a correction value of a light emitting current, so that the value of the light emitting current increases depending on the amount by which the base current increases relative to an initial value.

12 Claims, 9 Drawing Sheets

IMAGE FORMING APPARATUS WITH CONVEYANCE BELT MOVEMENT CORRECTION

INCORPORATED BY REFERENCE

This application is based upon and claims the benefit of priority from the corresponding Japanese Patent Application No. 2012-041380 filed on Feb. 28, 2012, the entire contents of which are incorporated herein by reference.

BACKGROUND

The present disclosure relates to an optical sensor used to correct skewing of a conveyance belt provided in an image forming apparatus such as an inkjet recording apparatus.

An inkjet recording apparatus typified by an inkjet printer records an image on paper by selectively ejecting ink droplets from a recording portion onto paper conveyed on a conveyance belt which is an endless belt. When the conveyance belt skews due to the conveyance belt shifting in the width direction of the conveyance belt (in other words, toward the near side or the far side within the inkjet recording apparatus), the position at which the image is recorded on the paper shifts relative to the position at which the image was originally supposed to have been recorded.

In view of this, an inkjet recording apparatus having a function of detecting the position of a side face of the conveyance belt in the width direction of the conveyance belt with an optical sensor, and correcting skewing of the conveyance belt has been proposed. This inkjet recording apparatus is provided with an endless belt whose side edge portions are formed nonlinearly, a belt moving portion, an optical binary sensor that is disposed so as to oppose a side edge portion of the endless belt and that detects the presence of the endless belt, and a control unit that corrects shift of the endless belt by controlling the belt moving portion based on detection results of the binary sensor.

A photo-interrupter provided with a light emitting portion and a light receiving portion may be used as the optical sensor for detecting the position of the side face of the conveyance belt.

SUMMARY

An image forming apparatus according to one aspect of the present disclosure is provided with a conveyance belt, an image forming portion, a belt moving mechanism, an optical sensor, a current generation portion, a position detection portion, a belt movement control unit, a reference value storage portion, a base current measurement portion, an initial value storage portion, and a correction value determination portion. The image forming portion forms an image on paper that is conveyed on the conveyance belt. The belt moving mechanism moves the conveyance belt in a width direction of the conveyance belt. The optical sensor includes a light emitting portion, and a light receiving portion in which a plurality of light receiving elements are aligned in the width direction of the conveyance belt, so that the number of light receiving elements that receive light irradiated by the light emitting portion differs depending on a position of a side face of the conveyance belt. The light receiving portion being configured to output a light receiving signal having a value that corresponds to the number of light receiving elements that receive light irradiated by the light emitting portion. The current generation portion generates an electric current that is supplied to the light emitting portion. The position detection portion causes the light emitting portion to emit light by causing the current generation portion to generate a light emitting current, which is the current supplied to the light emitting portion, when detecting the position of the side face of the conveyance belt, and detects the position of the side face of the conveyance belt based on the value of the light receiving signal output from the light receiving portion. The belt movement control unit moves the conveyance belt to correct skewing of the conveyance belt, by controlling the belt moving mechanism based on the position of the side face of the conveyance belt detected by the position detection portion. The reference value storage portion stores in advance a reference value, which is the value of the light receiving signal output from the light receiving portion and is used as a reference when correcting a value of the light emitting current. The base current measurement portion, in a case where a condition for correcting the value of the light emitting current is satisfied, monitors a decrease in the value of the light receiving signal while decreasing the current generated by the current generation portion, in a state where the conveyance belt is not positioned between the light emitting portion and the light receiving portion. The base current measurement portion, in a case where the value of the light receiving signal reaches the reference value stored in the reference value storage portion, then measures a value of a base current, which is the current generated by the current generation portion. The initial value storage portion stores in advance an initial value of the base current that is measured by the base current measurement portion. The correction value determination portion determines a correction value of the light emitting current, so that the value of the light emitting current increases, depending on an amount by which the value of the base current measured by the base current measurement portion increases relative to the initial value stored in the initial value storage portion. The position detection portion, in a case of detecting the position of the side face of the conveyance belt after the correction value determination portion determines the correction value, utilizes the correction value determined by the correction value determination portion as the value of the light emitting current.

An image forming apparatus according to another aspect of the present disclosure is provided with a conveyance belt, an image forming portion, a belt moving mechanism, an optical sensor, a current generation portion, a position detection portion, a belt movement control unit, a reference value storage portion, a base current measurement portion, an initial value storage portion, and a correction value determination portion. The image forming portion forms an image on paper that is conveyed on the conveyance belt. The belt moving mechanism moves the conveyance belt in a width direction of the conveyance belt. The optical sensor includes a light emitting portion, and a light receiving portion in which a plurality of light receiving elements are aligned in the width direction of the conveyance belt, so that the number of light receiving elements that receive light irradiated by the light emitting portion differs depending on a position of a side face of the conveyance belt. The light receiving portion being configured to outputs a light receiving signal having a value that corresponds to the number of light receiving elements that receive light irradiated by the light emitting portion. The current generation portion generates an electric current that is supplied to the light emitting portion. The position detection portion causes the light emitting portion to emit light by causing the current generation portion to generate a light emitting current, which is the current supplied to the light emitting portion, when detecting the position of the side face of the conveyance belt, and detects the position of the side face of the conveyance belt based on the value of the light receiving signal output from the light receiving portion. The belt movement control unit moves the conveyance belt to correct skewing of the conveyance belt, by controlling the belt moving mechanism based on the position of the side face of the conveyance belt detected by the position detection portion. The reference value storage portion stores in advance a reference value, which is the value of the light receiving signal output from the light receiving portion and is used as a reference when correcting a value of the light emitting current. The base current measurement portion, in a case where a condition for correcting the value of the light emitting current is satisfied, monitors an increase in the value of the light receiving signal while increasing the current generated by the current generation portion, in a state where the conveyance belt is not positioned between the light emitting portion and the light receiving portion. The base current measurement portion, in a case where the value of the light receiving signal exceeds the reference value stored in the reference value storage portion, then measures a value of a base current, which is the current generated by the current generation portion. The initial value storage portion stores in advance an initial value of the base current that is measured by the base current measurement portion. The correction value determination portion determines a correction value of the light emitting current, so that the value of the light emitting current increases, depending on an amount by which the value of the base current measured by the base current measurement portion increases relative to the initial value stored in the initial value storage portion. The position detection portion, in a case of detecting the position of the side face of the conveyance belt after the correction value determination portion determines the correction value, utilizes the correction value determined by the correction value determination portion as the value of the light emitting current.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION OF THE PREFERRED EMBODIMENTS

Figure 1:
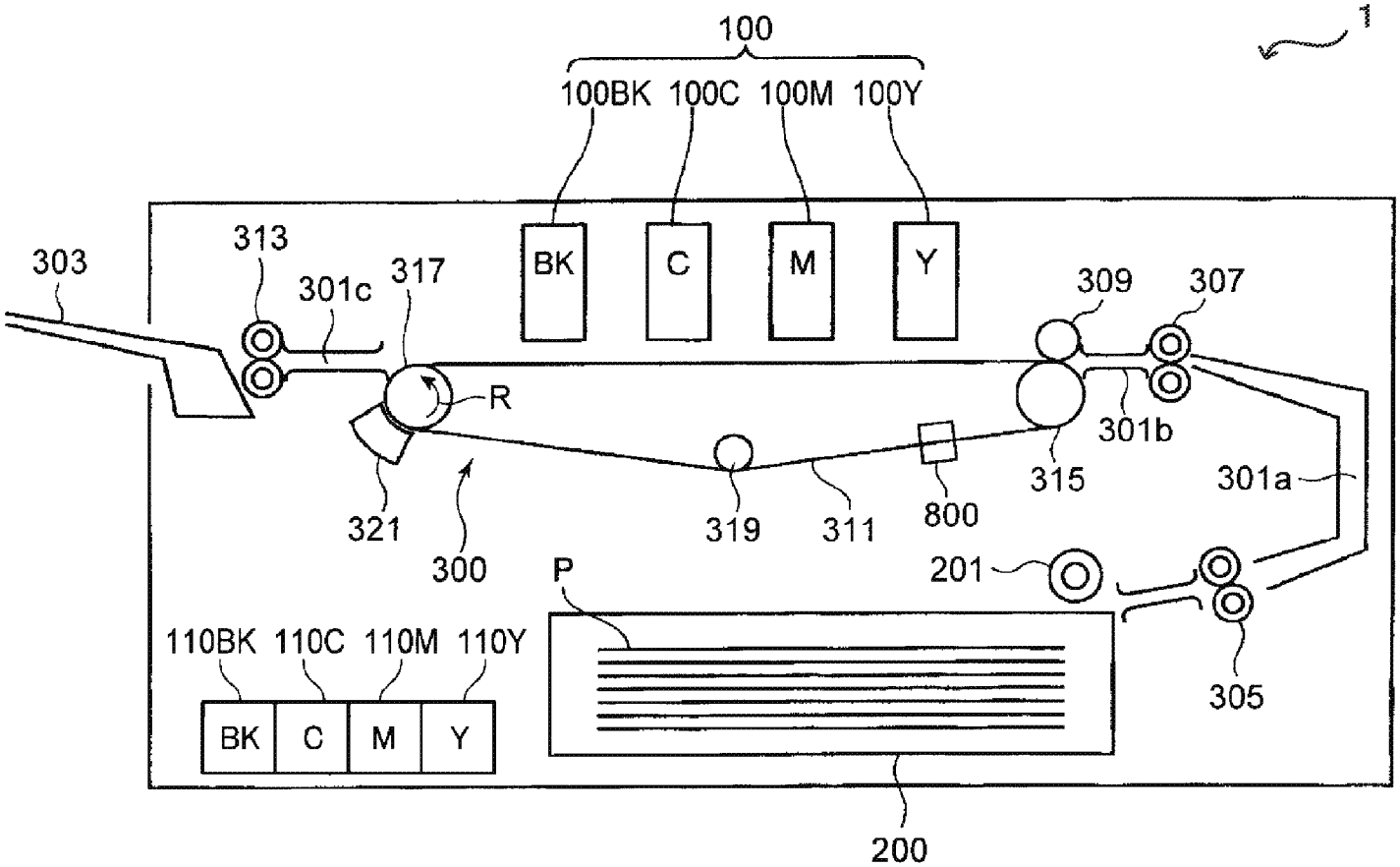
FIG. 1 is a schematic diagram showing an internal structure of an inkjet recording apparatus of one embodiment according to the present disclosure.

Hereinafter, embodiments of the present disclosure will be described in detail based on the drawings. FIG. 1 is a schematic showing the internal structure of an inkjet recording apparatus 1 according to one embodiment of the present disclosure. The inkjet recording apparatus 1 is a printer employing an inkjet method. Note that the inkjet recording apparatus 1 is also an example of an image forming apparatus according to the present disclosure. The present disclosure is applicable not only to a printer but also to a copier, a facsimile machine and a multifunction peripheral having a copy function, a facsimile function and a printer function for recording images with an inkjet method. The inkjet recording apparatus 1 is provided with a recording portion 100, a paper storage portion 200, a paper conveying portion 300, conveying paths 301*a*, 301*b*, and 301*c*, and a discharge tray 303.

The paper storage portion 200 is disposed in a lowermost portion of the inkjet recording apparatus 1, and is able to store a stack of paper P. The uppermost sheet of paper P in the stack of paper P stored in the paper storage portion 200 is fed out toward the conveying path 301*a* by the driving of a pickup roller 201.

The paper conveying portion 300 is provided with pairs of conveying rollers 305 and 307, a suction roller 309, a conveyance belt 311, a pair of discharge rollers 313, and the like. The pairs of conveyance rollers 305 and 307 convey the paper P along the conveying paths 301*a* and 301*b*.

Paper P that has passed along the conveying path 301*b* passes through a nip portion between the suction roller 309 and the conveyance belt 311, and is conveyed to a position opposed to the recording portion 100. The surface of the suction roller 309 contacts the conveyance belt 311, and suctions the paper P while at the same time pressing the paper P against the conveyance belt 311.

As for the conveyance belt 311, a dielectric resin sheet, for example, is used, and a belt without joints (endless belt) is mainly used. The conveyance belt 311 is supported by a driven roller 315 positioned on the paper feed side (upstream side), a driving roller 317 positioned on the paper discharge side (downstream side), and a tension roller 319. When the driving roller 317 rotates in a counterclockwise direction R, the conveyance belt 311 rotates counterclockwise, and the driven roller 315 and the tension roller 319 are driven by the conveyance belt 311 and rotate counterclockwise. The tension roller 319 is able to apply tension so that there is no slack in the conveyance belt 311 between the driving roller 317 and the driven roller 315.

The recording portion 100 is provided with a recording head 100Y for a yellow image, a recording head 100M for a magenta image, a recording head 100C for a cyan image, and a recording head 100BK for a black image. These recording heads eject yellow, magenta, cyan and black ink droplets toward the paper P, and sequentially record images. As the method by which the recording heads 100Y, 100M, 100C and 100BK eject ink droplets, a piezo method that involves pushing ink out from a nozzle using a piezoelectric element may be used, for example. Note that the recording portion 100 is also an example of an image forming portion that forms an image on paper conveyed on the conveyance belt 311.

A cleaning apparatus 321 removes ink adhering to the surface of the conveyance belt 311. The paper P on which the image was recorded passes along the conveying path 301*c*, and is discharged into the discharge tray 303 by a pair of discharge rollers 313.

Four ink tanks 110Y, 110M, 110C and 110BK are disposed to the lower left of the paper conveying portion 300 in FIG. 1. Yellow ink is replenished from the ink tank 110Y to the recording head 100Y through a supply tube (not shown). Magenta ink is replenished from the ink tank 110M to the recording head 100M through a supply tube (not shown). Cyan ink is replenished from the ink tank 110C to the recording head 100C through a supply tube (not shown). Black ink is replenished from the ink tank 110BK to the recording head 100BK through a supply tube (not shown).

An optical sensor 800 is disposed near one side face of the conveyance belt 311, between the driven roller 315 and the tension roller 319. The optical sensor 800 is not limited to this location, and can be disposed near one side face of the conveyance belt 311, between the driving roller 317 and the tension roller 319. The optical sensor 800 is used for detecting the position of one side face of the conveyance belt 311. The optical sensor 800 will be described in detail later.

Figure 2:
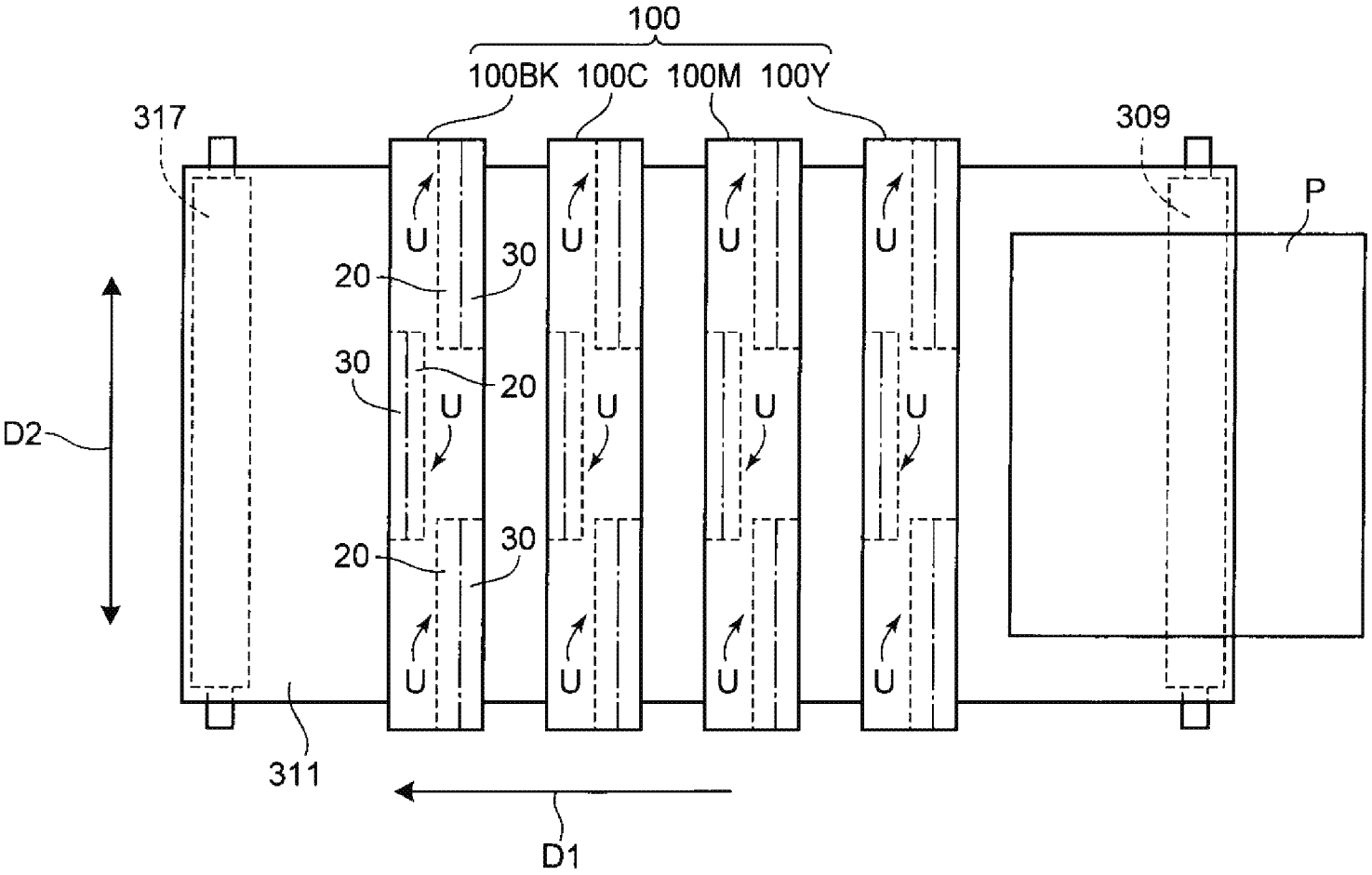
FIG. 2 is a plan view of a recording portion and a conveyance belt shown in FIG. 1 seen from above.

FIG. 2 is a plan view of the recording portion 100 and the conveyance belt 311 seen from above. The recording head 100Y, recording head 100M, recording head 100C and recording head 100BK are disposed in the direction in which the conveyance belt 311 rotates, toward the downstream side from the upstream side of a paper conveying direction D1 (sub-scanning direction).

The recording heads 100Y, 100M, 100C and 100BK may employ single pass (one pass) systems. These recording heads each include three units U aligned in a main scanning direction D2.

Each unit U is provided with a head portion 20 and a drive voltage generation portion 30. In the head portion 20 there are multiple ink chambers, and respective piezoelectric element and nozzle pairs, each of which communicates with a corresponding ink chamber (ink chambers not shown), the plurality of nozzles being aligned in the main scanning direction D2. The drive voltage generation portion 30 generates a drive voltage of the head portion 20. Ink droplets are ejected from the nozzles by applying the drive voltage to the piezoelectric elements to deform the piezoelectric elements and increase the ink pressure in the ink chambers.

Figure 3:
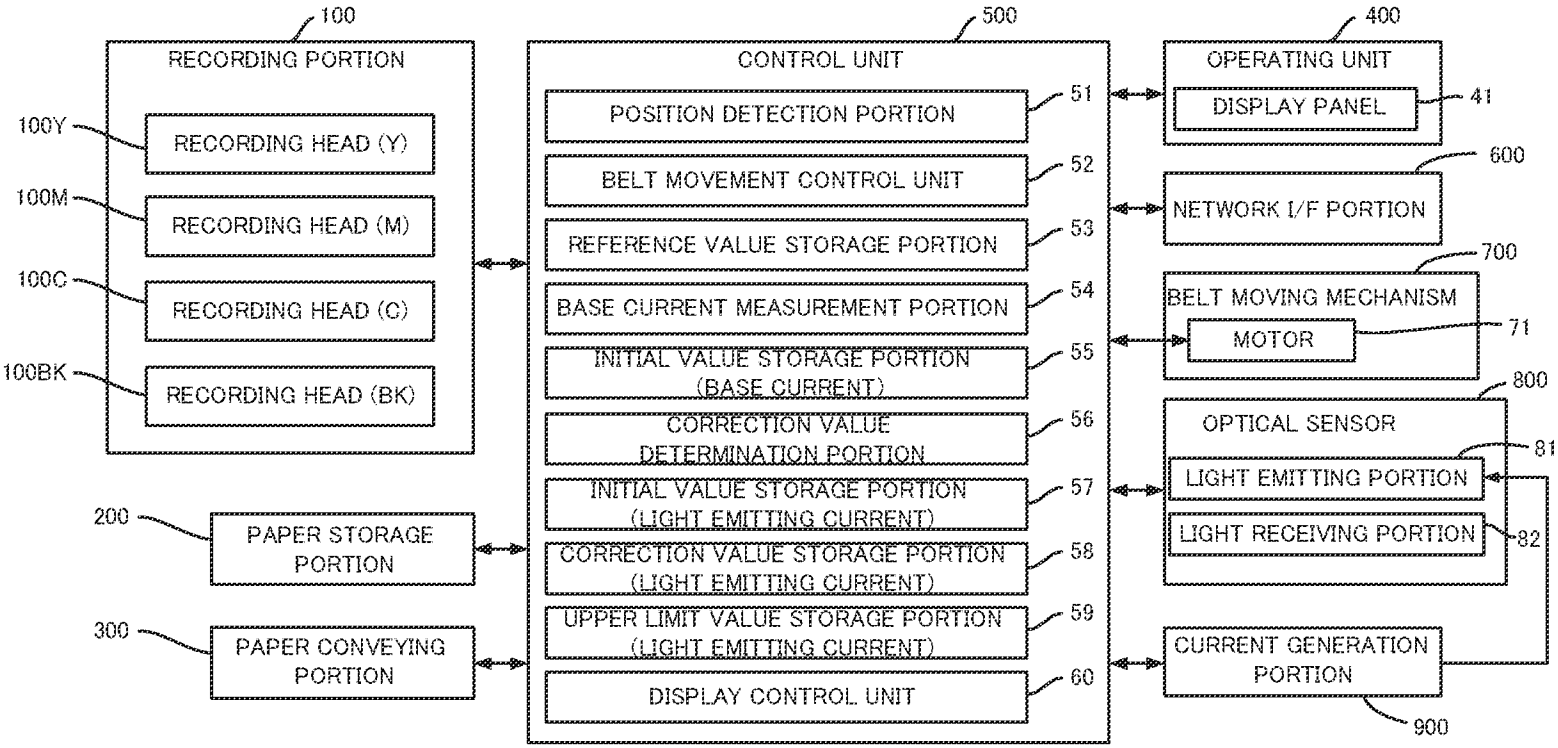
FIG. 3 is a block diagram showing a configuration of the inkjet recording apparatus shown in FIG. 1.

FIG. 3 is a block diagram showing a configuration of the inkjet recording apparatus 1 shown in FIG. 1. The inkjet recording apparatus 1 has a configuration in which the recording portion 100, the paper storage portion 200, the paper conveying portion 300, an operating unit 400, a control unit 500, a network I/F portion 600, a motor 71 of a belt moving mechanism 700, the optical sensor 800 and a current generation portion 900 are connected to one another by a bus. Because the recording portion 100, the paper storage portion 200 and the paper conveying portion 300 have already described, description of these portion is omitted for the sake of brevity.

The operating unit 400 has a display panel 41 (exemplary display portion) that displays various messages, and operation buttons for inputting various operating instructions such as a power key and a reset key.

The control unit 500 is provided with a CPU (Central Processing Unit), a ROM (Read Only Memory), a RAM (Random Access Memory), an image memory, and the like. The CPU executes controls for operating the inkjet recording apparatus 1 on the above constituent elements of the inkjet recording apparatus 1 such as the recording portion 100 and the like. The ROM stores software for controlling operation of the inkjet recording apparatus 1. The RAM is utilized for temporary storage of data generated when software is executed, storage of application software, and the like. The image memory temporarily stores image data (image data transmitted from a personal computer).

The network I/F portion 600 is connected to a LAN (Local Area Network). The network I/F portion 600 is a communication interface circuit that executes communication with terminal apparatuses such as personal computers and the like connected to the LAN.

Figure 4:
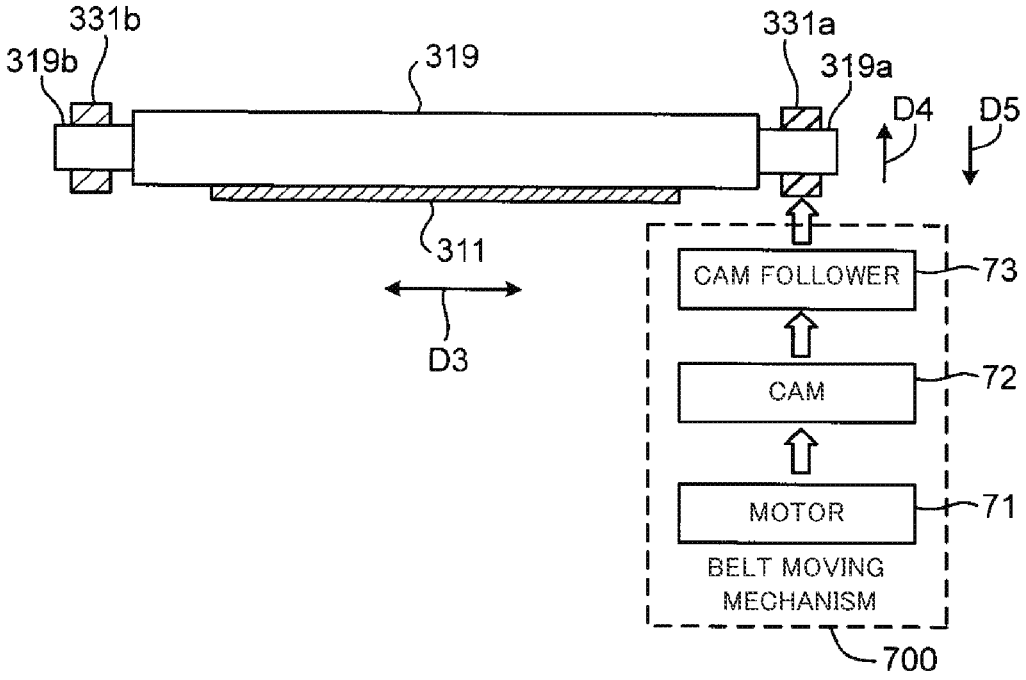
FIG. 4 is a schematic diagram describing a belt moving mechanism.

The belt moving mechanism 700 includes the motor 71. The belt moving mechanism 700 will be described using FIG. 4. FIG. 4 is a schematic diagram illustrating the belt moving mechanism 700. The conveyance belt 311, the tension roller 319, the belt moving mechanism 700 and so forth are shown in FIG. 4.

An image is recorded on paper conveyed on the conveyance belt 311 by the recording portion 100 employing an inkjet method (FIG. 1). A cross-section of the conveyance belt 311 that cuts the conveyance belt 311 in a width direction D3 of the conveyance belt 311 is shown in FIG. 4. The width direction D3 of the conveyance belt 311 coincides with the main scanning direction D2 (FIG. 2) and the longitudinal direction of the tension roller 319. One end 319*a* and the other end 319*b* of the tension roller 319 are rotatably supported by bearings 331*a* and 331*b*, respectively.

The belt moving mechanism 700 is a mechanism that moves the conveyance belt 311 in the width direction D3 of the conveyance belt 311, and is provided with the motor 71, a cam 72, a cam follower 73 and the like. A stepping motor is used as the motor 71. When the motor 71 rotates in the forward direction, the cam 72 rotates in the forward direction, and the bearing 331*a* moves in an upward direction D4 in accordance with the cam follower 73. The one end 319*a* of the tension roller 319 is thereby positioned higher than the other end 319*b*. Therefore, when the conveyance belt 311 is rotated by the driving roller 317, the conveyance belt 311 can be gradually shifted to the other end 319*b* side by the action of gravity and the like.

In contrast, when the motor 71 rotates in the opposite direction, the cam 72 rotates in the opposite direction, and the bearing 331*a* move in a downward direction D5 in accordance with the cam follower 73. The one end 319*a* of the tension roller 319 is thereby positioned lower than the other end 319*b*. Therefore, when the conveyance belt 311 is rotated by the driving roller 317, the conveyance belt 311 can be gradually shifted to the one end 319*a* side by the action of gravity and the like.

Figure 5:
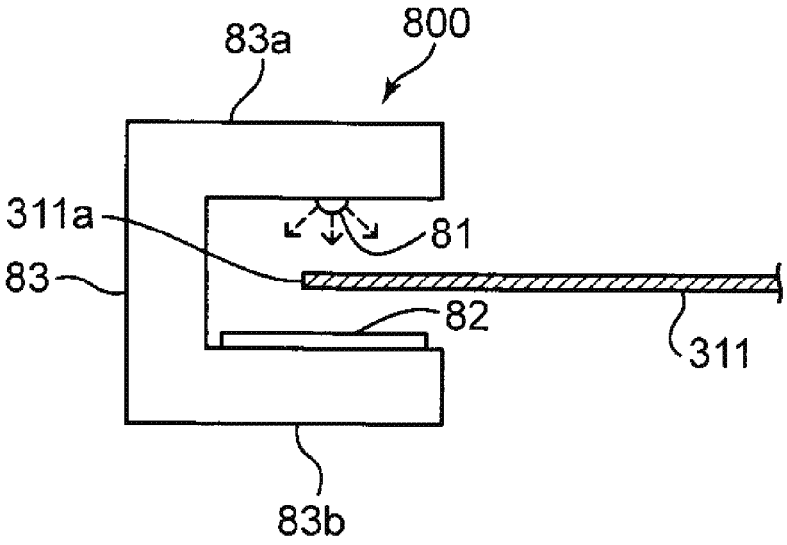
FIG. 5 is a schematic diagram of an optical sensor.

Returning to FIG. 3, the optical sensor 800 is provided with a light emitting portion 81 and a light receiving portion 82. FIG. 5 is a schematic diagram of the optical sensor 800. The optical sensor 800 is a photo-interrupter, and is provided with the light emitting portion 81, the light receiving portion 82 and a frame 83. The frame 83 has an upper-side portion 83*a* and a lower-side portion 83*b* opposed thereto. The light emitting portion 81 is attached to the upper-side portion 83*a*, and the light receiving portion 82 is attached to the lower-side portion 83*b*. The frame 83 is supported with a frame (not shown) of the inkjet recording apparatus 1, so that one side face 311*a* of the conveyance belt 311 is positioned between the light emitting portion 81 and the light receiving portion 82.

Figure 6:
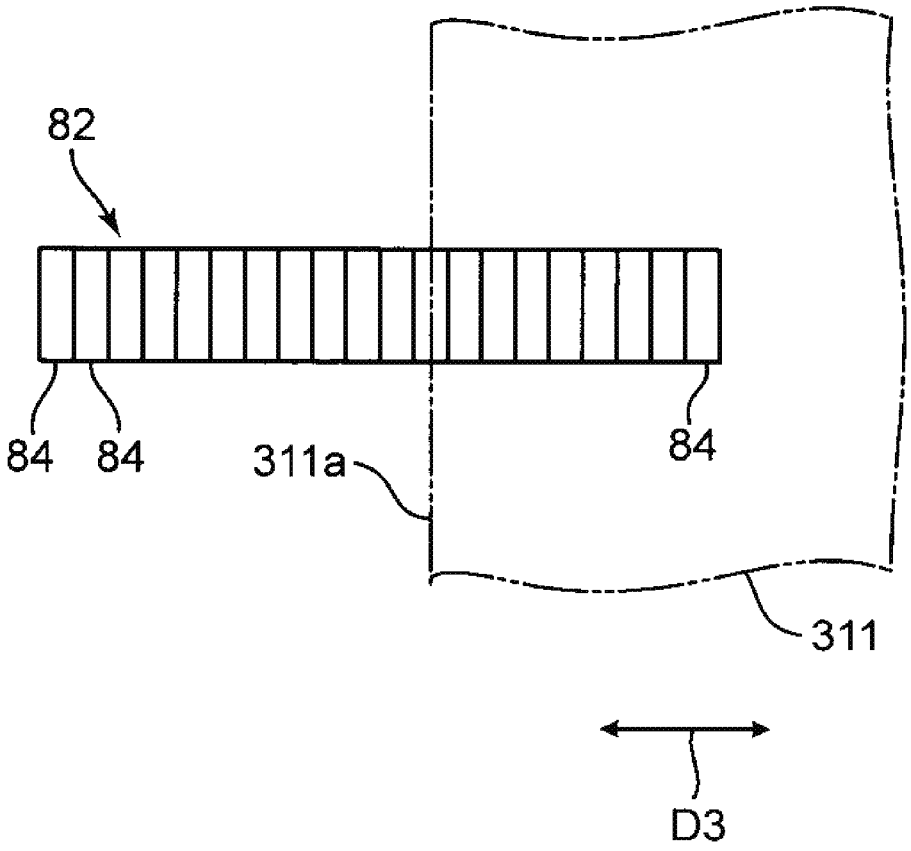
FIG. 6 is a plan view of a light receiving portion of the optical sensor.

FIG. 6 is a plan view of the light receiving portion 82. The light receiving portion 82 is a photodiode array, and has a configuration formed by arranging twenty light receiving elements 84 (e.g., photodiodes), for example, on a single semiconductor substrate. The twenty light receiving elements 84 are aligned in the width direction D3 of the conveyance belt 311, so that the number of light receiving elements 84 that receive light irradiated by the light emitting portion 81 differs depending on the position of the side face 311*a* of the conveyance belt 311. The light receiving portion 82 outputs a light receiving signal whose value depends on the number of light receiving elements 84 that received light irradiated by the light emitting portion 81.

Figure 7:
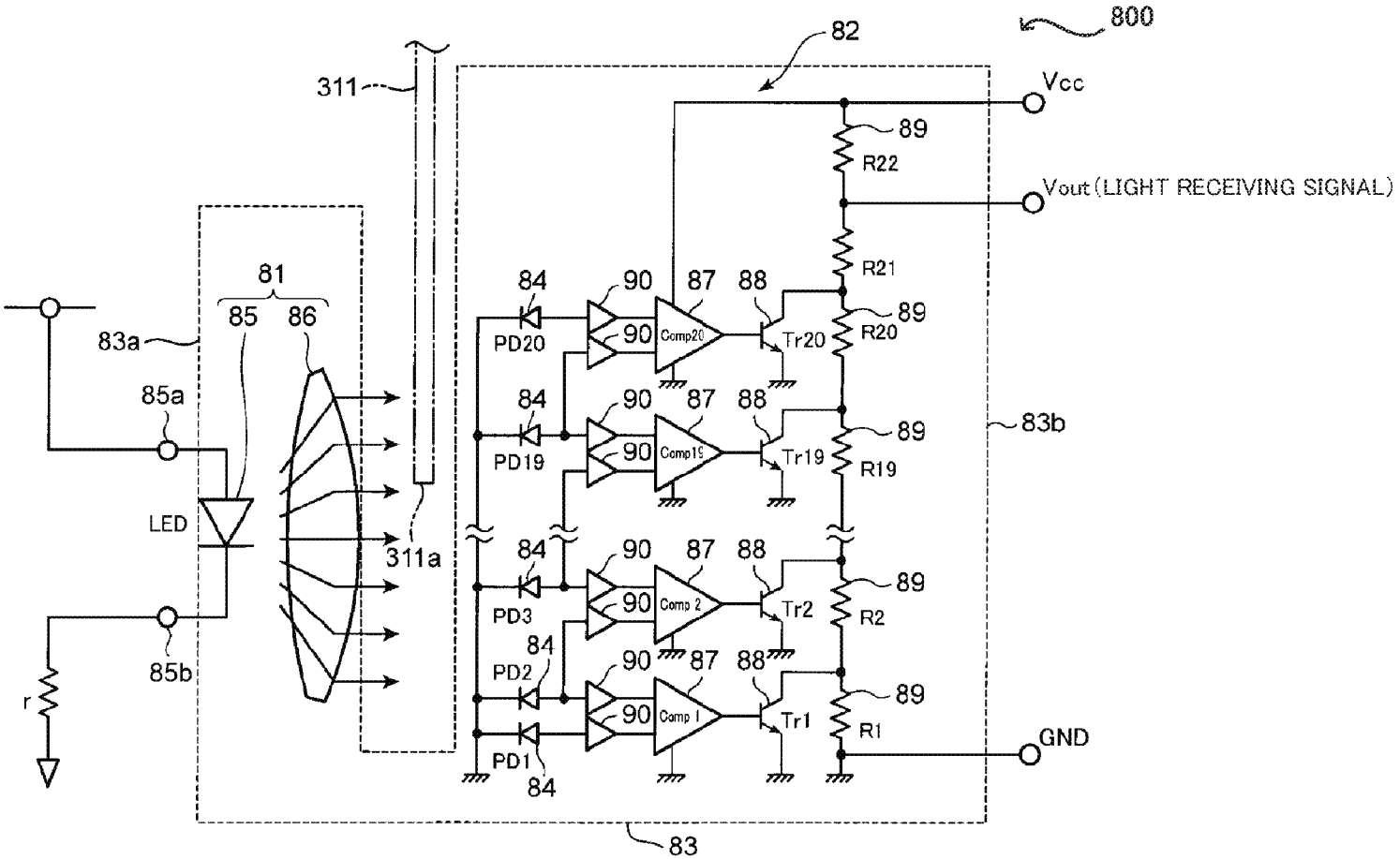
FIG. 7 is a circuit diagram of the optical sensor.

FIG. 7 is a circuit diagram of the optical sensor 800. The light emitting portion 81 is provided with an LED 85 and a collimator lens 86. The LED 85 is a light source, with an anode electrode 85*a* of the LED 85 being connected to a power supply and a cathode electrode 85*b* being grounded via a resistor r. The collimator lens 86 converts light irradiated from the LED 85 into parallel light.

The light receiving portion 82 is provided with twenty light receiving elements 84, twenty comparators 87, twenty switching transistor 88 and the like.

In adjacent light receiving elements 84, an anode of one light receiving element 84 is connected to one input terminal of a comparator 87 via an amplifier 90, and an anode of the other light receiving element 84 is connected to the other input terminal of the comparator 87 via an amplifier 90. The output terminal of the comparators 87 is connected to a base of the switching transistors 88.

An example will now be described with two light receiving elements 84 indicated by PD19 and PD20. The anode of the light receiving element 84 indicated by PD19 is connected to one input terminal of a comparator 87 indicated by Comp20 via an amplifier 90. The light receiving element 84 indicated by PD20 is disposed next to the light receiving element 84 indicated by PD19. The anode of the light receiving element 84 indicated by PD20 is connected to the other input terminal of the comparator 87 indicated by Comp20 via an amplifier 90. The output terminal of the comparator 87 indicated by Comp20 is connected to the base of a switching transistor 88 indicated by Tr20. The input terminal of these amplifiers 90 is pulled up with a resistor which is not shown.

The light receiving portion 82 is provided with a resistor body constituted by twenty-two resistors 89 that are connected in series between the power supply and ground. One end (resistor 89 indicated by R22) of this resistor body is connected to a terminal Vcc that is connected to the power supply. The other end (resistor 89 indicated by R1) of the resistor body is connected to a terminal GND that is connected to ground. An output terminal Vout of the light receiving portion 82 is connected between the resistor 89 indicated by R22 and a resistor 89 indicated by R21. A light receiving signal is output from the output terminal Vout.

An emitter of each switching transistor 88 is grounded. A collector of each switching transistor 88 is connected between adjacent resistors 89. An example will now be described with the switching transistor 88 indicated by Tr20. The collector of the switching transistor 88 indicated by Tr20 is connected between the resistor 89 indicated by R20 and the resistor 89 indicated by R21.

Operation of the optical sensor 800 will be described briefly. When the LED 85 of the light emitting portion 81 is caused to emit light, the light passes through the collimator lens 86 and moves in a direction toward the light receiving portion 82. In the case where none of the twenty light receiving elements 84 receive light (all are shaded from light), the value of the light receiving signal will be a minimum value (e.g., 0.7 V). The value of light receiving signal gradually increases (in the case where only the light receiving element 84 indicated by PD1 receives light, in the case where only the light receiving elements 84 indicated by PD1 and PD2 receive light, in the case where only the light receiving elements 84 indicated by PD1 to PD3 receive light, and so on) as the number of light receiving elements 84 that receive light increases. In the case where all of the twenty light receiving elements 84 receive light (all are exposed to light), the value of the light receiving signal will be at a maximum value (e.g., 3.3 V). In a state where the conveyance belt 311 is not between the light emitting portion 81 and the light receiving portion 82, the value of a light receiving signal is maximized because all of the twenty light receiving elements 84 receive light.

As mentioned above, according to the optical sensor 800, the value (voltage) of the light receiving signal output from the light receiving portion 82 increases as the number of light receiving elements 84 that receive light irradiated by the light emitting portion 81 increases. Therefore, because the value of the light receiving signal differs depending on the position of the side face 311*a* of the conveyance belt 311, the position of the side face 311*a* of the conveyance belt 311 can be detected, based on the value of the light receiving signal.

Returning to FIG. 3, the current generation portion 900 generates an electric current that is supplied to the light emitting portion 81.

The control unit 500 is provided, as a functional block, with a position detection portion 51, a belt movement control unit 52, a reference value storage portion 53, a base current measurement portion 54, an initial value storage portion 55, a correction value determination portion 56, an initial value storage portion 57, a correction value storage portion 58, an upper limit value storage portion 59, and a display control unit 60.

The position detection portion 51 causes the light emitting portion 81 to emit light by causing the current generation portion 900 to generate a light emitting current, and detects the position of the side face 311*a* of the conveyance belt 311 according to the value of the light receiving signal output from the light receiving portion 82. The light emitting current is the current supplied to the light emitting portion 81 when detecting the position of the side face 311*a* of the conveyance belt 311.

The belt movement control unit 52 moves the conveyance belt 311 to correct skewing of the conveyance belt 311 by controlling the belt moving mechanism 700, based on the position of the side face 311*a* of the conveyance belt 311 detected by the position detection portion 51.

The reference value storage portion 53 stores in advance a reference value, which is the value of the light receiving signal output from the light receiving portion 82 and serves as a reference when correcting the value of light emitting current. The reference value is, for example, 0 in the case where the value of the light receiving signal can be 0, and is the minimum value or the like of the value of the light receiving signal in the case where the value of the light receiving signal cannot be 0 due to dark current or the like.

In the case where a condition for correcting the value of light emitting current is satisfied, the base current measurement portion 54 monitors the decrease in the value of the light receiving signal while decreasing the current generated by the current generation portion 900, in a state where the conveyance belt 311 is not positioned between the light emitting portion 81 and the light receiving portion 82. The base current measurement portion 54 measures the value of a base current, which is the current generated by the current generation portion 900, occurring at the point in time when the value of the light receiving signal reaches the reference value stored in the reference value storage portion 53. That is, the base current measurement portion 54 monitors a change involving the decrease in the value of the light receiving signal while changing the current generated by the current generation portion 900 by decreasing the current, and measures the value of the base current, which is the current generated by the current generation portion 900, that occurs at the point in time when the value of the light receiving signal reaches the reference value stored in the reference value storage portion 53.

The initial value storage portion 55 stores in advance an initial value of the base current that is measured by the base current measurement portion 54. The initial value is the value of the base current measured prior to the inkjet recording apparatus 1 first being used (e.g., at the time of manufacture of the inkjet recording apparatus 1).

The correction value determination portion 56 determines the correction value of the light emitting current, so that the value of the light emitting current increases, according to the amount by which the value of the base current measured by the base current measurement portion 54 increases relative to the initial value stored in the initial value storage portion 55. In the case where the position detection portion 51 detects the position of the side face 311*a* of the conveyance belt 311 after the correction value determination portion 56 determines the correction value, the position detection portion 51 uses the correction value determined by the correction value determination portion 56 as the value of the light emitting current.

The initial value storage portion 57 stores in advance an initial value of the light emitting current. The initial value of the light emitting current is the value of the light emitting current set prior to the inkjet recording apparatus 1 first being used (e.g., at the time of manufacture of the inkjet recording apparatus 1).

The correction value storage portion 58 stores the correction value of the light emitting current determined by the correction value determination portion 56. The correction value stored in the correction value storage portion 58 is updated, whenever the correction value determination portion 56 newly determines the correction value of the light emitting current.

The upper limit value storage portion 59 stores in advance an upper limit value of the light emitting current. The upper limit value is the value of the light emitting current around which the light emitting portion 81 would be damaged.

The display control unit 60 displays a warning on the display panel 41, in the case where the correction value determined by the correction value determination portion 56 exceeds the upper limit value stored in the upper limit value storage portion 59.

Figure 8:
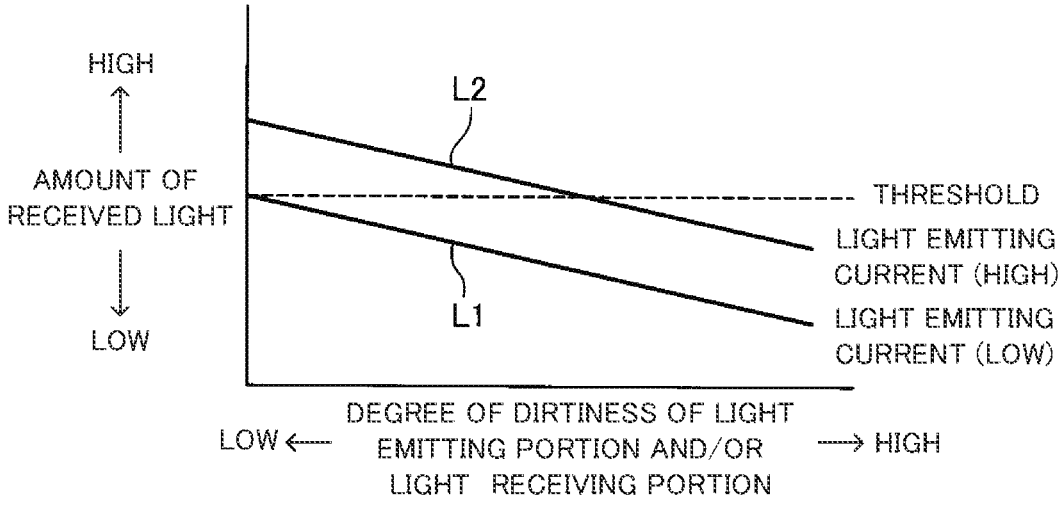
FIG. 8 is a graph showing a relationship between dirtiness of a light emitting portion and/or a light receiving portion and an amount of light received by the light receiving portion.

A threshold of the amount of light received by the light receiving portion 82 is set. Using this threshold, the position detection portion 51 detects the position of the side face 311*a* of the conveyance belt 311. When the amount of light received by the light receiving portion 82 is less than or equal to the threshold, the position detection portion 51 is not able to detect the position of the side face 311*a* of the conveyance belt 311. Therefore, if the amount of light received by the light receiving portion 82 falls to less than or equal to the threshold due to dirtiness of the light emitting portion 81 and/or the light receiving portion 82, the position of the side face 311*a* of the conveyance belt 311 can no longer be detected. FIG. 8 is a graph showing a relationship between the dirtiness of the light emitting portion 81 and/or the light receiving portion 82 and amount of light received the light receiving portion 82. The horizontal axis of the graph shows the degree of dirtiness of the light emitting portion 81 and/or the light receiving portion 82, and the vertical axis shows the amount of light received by the light receiving portion 82. A straight line L1 on the graph shows the relationship in the case where the light emitting current supplied to the light emitting portion 81 is comparatively low, and a straight line L2 shows the case where the light emitting current supplied to the light emitting portion 81 is comparatively high.

Because less light is irradiated by the light emitting portion 81 if the light emitting current become smaller (straight line L1), the amount of received light falls to less than or equal to the threshold with slight dirtiness of the light emitting portion 81 and/or light receiving portion 82. In contrast, because the amount of light irradiated by the light emitting portion 81 increases if the light emitting current become higher (straight line L2), the amount of received light can be increased above the threshold, even when the degree of dirtiness of the light emitting portion 81 and/or the light receiving portion 82 is significant.

If the light emitting current is set to a high value from the beginning (e.g., upper limit value of the light emitting current) and a large amount of light is irradiated by the light emitting portion 81, the amount of light received by the light receiving portion 82 can be increased above the threshold, even when the degree of dirtiness of the light emitting portion 81 and/or the light receiving portion 82 is significant. However, when the light emitting portion 81 and/or the light receiving portion 82 are not dirty or where the degree of dirtiness is not significant, the amount of light received by the light receiving portion 82 will greatly exceed the threshold. Therefore, because a light emitting current of a higher value than necessary will be supplied to the light emitting portion 81, this will be contrary to energy saving.

Figure 9:
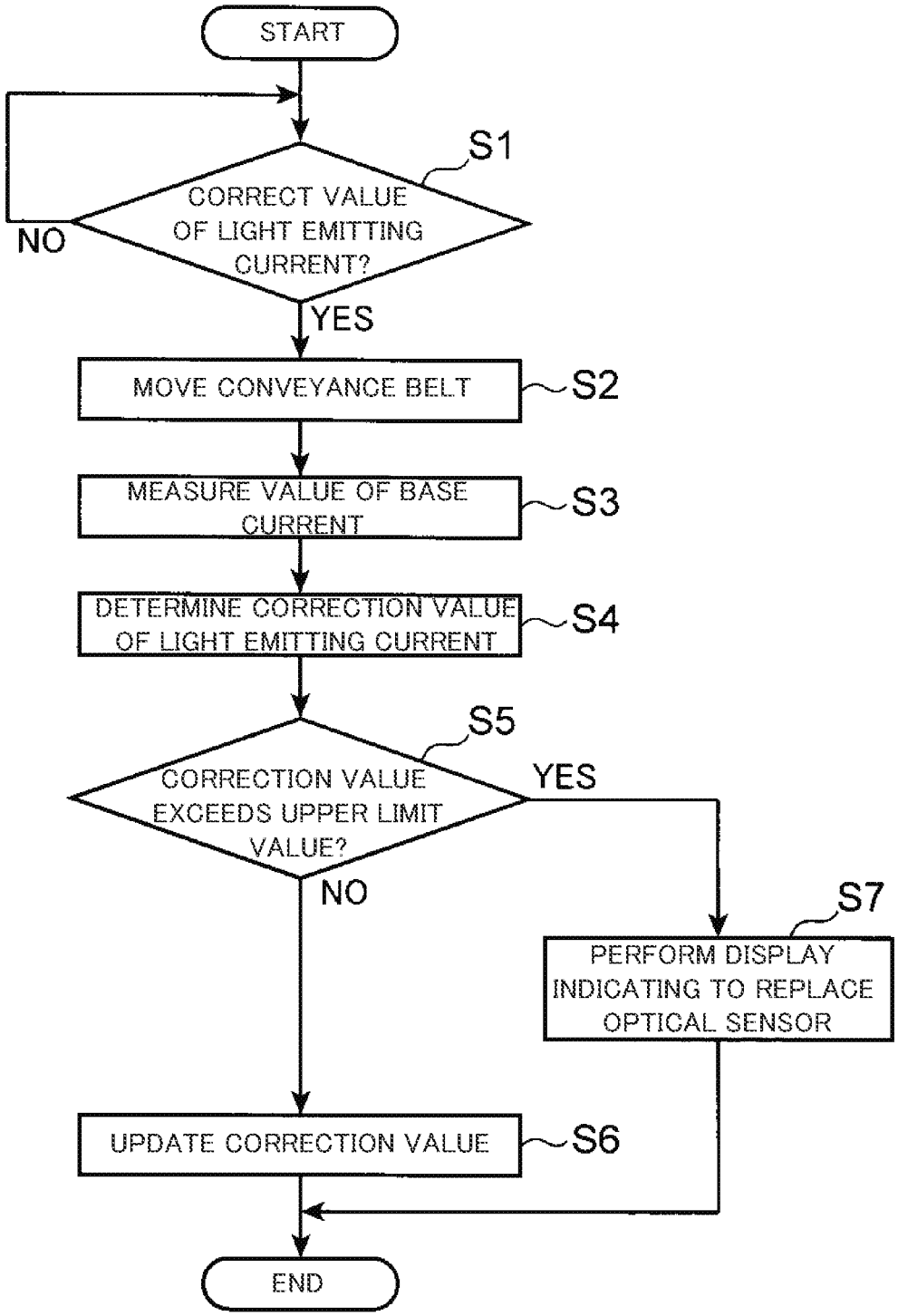
FIG. 9 is a flowchart illustrating correction for increasing the value of a light emitting current that is executed by the inkjet recording apparatus according to the embodiment.

The inkjet recording apparatus 1 according to the present embodiment performs correction for increasing the value of the light emitting current as the degree of dirtiness of the light emitting portion 81 and/or the light receiving portion 82 increases. This correction will be described. FIG. 9 is a flowchart illustrating this correction.

The reference value of the light receiving signal stored in the reference value storage portion 53 of FIG. 3 is given as 0 V, the measured value of the base current measured by the base current measurement portion 54 of FIG. 3 is given as ia, the initial value of the base current stored in the initial value storage portion 55 of FIG. 3 is given as i0, the correction value of the light emitting current generated by the current generation portion 900 of FIG. 3 is given as Ia, and the initial value that the light emitting current value stored in the initial value storage portion 57 of FIG. 3 is given as M.

The size of the initial value I0 of the light emitting current is greater than the initial value i0 of the base current and smaller than the upper limit value of the light emitting current, and enables the bare minimum amount of light that is required for detecting the position of the side face 311*a* of the conveyance belt 311 to be supplied to the light receiving portion 82.

The base current measurement portion 54 determines whether a condition for correcting the value of the light emitting current is satisfied (step S1). Correction of the value of the light emitting current may be executed whenever a prescribed number of sheets (e.g., 10,000 sheets) are printed with the inkjet recording apparatus 1. Also, it is conceivable for the base current measurement portion 54 to determine whether a precondition set in advance is satisfied, and, if the precondition is satisfied, to determine whether the value of the light emitting current needs to be corrected. For example, it is conceivable for the base current measurement portion 54 to determine whether the value of the light emitting current needs to be corrected, in the case where a precondition for such as printing of a prescribed number of sheets (e.g., 10,000 sheets) or passage of a prescribed period of time is satisfied. In this case, the value of the light emitting current is not corrected if there is no need to correct the value of the light emitting current, even when a precondition such as printing of a prescribed number of sheets or passage of a prescribed period of time is satisfied. Note that it is conceivable for the base current measurement portion 54 to perform the determination of whether the value of the light emitting current needs to be corrected by, for example, determining whether the amount of light received by the light receiving portion 82 when the light emitting portion 81 is caused to emit light is less than or equal to a given value set in advance.

Figure 10:
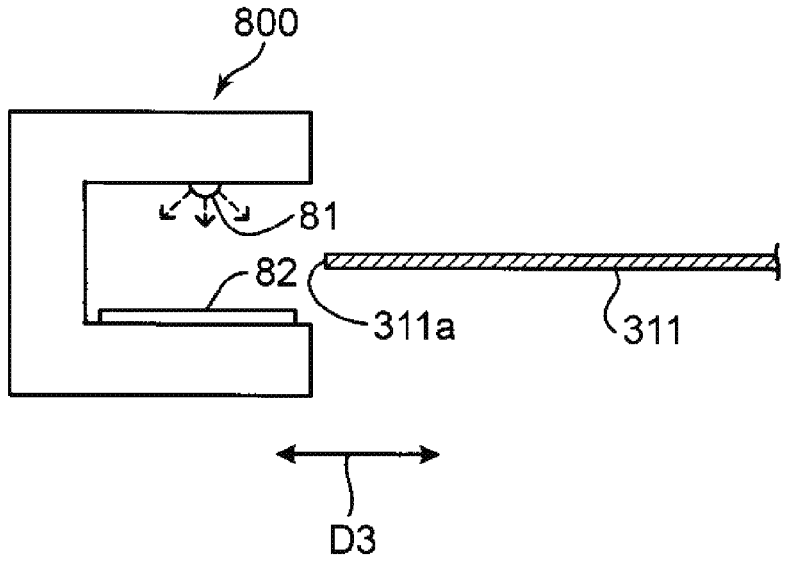
FIG. 10 is a schematic diagram showing a state where the conveyance belt is not positioned between the light emitting portion and the light receiving portion.

If the base current measurement portion 54 does not determine that a condition for correcting the value of the light emitting current is satisfied (No at step S1), the processing of step S1 is repeated. If the base current measurement portion 54 determines that a condition for correcting the value of the light emitting current is satisfied (Yes at step S1), the belt movement control unit 52 control the belt moving mechanism 700, when the conveyance belt 311 is not rotating, to shift the conveyance belt 311 in the width direction D3 of the conveyance belt 311, so that the conveyance belt 311 is not positioned between the light emitting portion 81 and the light receiving portion 82, as shown in FIG. 10 (step S2). FIG. 10 shows the same optical sensor 800 as FIG. 5, a difference from FIG. 5 being the position of the side face 311*a* of the conveyance belt 311. As shown in FIG. 10, the side face 311*a* of the conveyance belt 311 is not positioned between the light emitting portion 81 and the light receiving portion 82.

The base current measurement portion 54 monitors the decrease in the value of the light receiving signal output from the light receiving portion 82 while decreasing the current generated by the current generation portion 900, in the state where the conveyance belt 311 is not positioned between the light emitting portion 81 and the light receiving portion 82. That is, monitoring of the value of the light receiving signal is started from a state where the amount of light irradiated by the light emitting portion 81 has been increased by comparatively increasing the value of the current generated by the current generation portion 900. The decrease in the value of the light receiving signal is monitored while gradually reducing the value of the current generated by the current generation portion 900.

The base current measurement portion 54 measures the value of the base current generated by the current generation portion 900 occurring, at the point in time when the value of the light receiving signal reaches the reference value (0 V) (step S3).

The correction value determination portion 56 computes a rate of increase α of the measured value is of the base current relative to the initial value i0 of base current, using the following formula.

$$\alpha=(ia-i0)/i0$$

Because the amount of current supplied to the light emitting portion 81 is substantially proportional to the amount of light irradiated by the light emitting portion 81, the rate of increase α can be regarded as the attenuation rate of the amount of light received by the light receiving portion 82. The correction value determination portion 56 determines the correction value Ia of the light emitting current using the following formula (step S4).

$$Ia=I0\times\{1/(1-\alpha)\}$$

The correction value Ia is a value obtained by increasing the initial value I0 of the light emitting current, based on the amount by which the measured value ia of the base current is increases relative to the initial value i0 of the base current.

Note that the correction value determination portion 56 may store in advance a table in which measured values ia of the base current are associated with correction values Ia of the light emitting current, and may determine the correction value Ia of the light emitting current using this table, rather than the method using the above two formulas.

The position detection portion 51 determines whether the correction value Ia of the light emitting current exceeds the upper limit value of the light emitting current (step S5). The position detection portion 51, in the case of not determining that the correction value Ia of the light emitting current exceeds the upper limit value of the light emitting current (No at step S5), or in other words, in the case of determining that the correction value Ia does not exceed the upper limit value, updates the correction value Ia stored in the correction value storage portion 58 (step S6). The position detecting portion 51 thereby uses the updated correction value Ia when next detecting the position of the side face 311*a* of the conveyance belt 311.

On the other hand, if the position detection portion 51 determines that the correction value Ia of the light emitting current exceeds the upper limit value of the light emitting current (Yes at step S5), the display control unit 60 displays a warning indicating to replace the optical sensor 800 on the display panel 41 (step S7). The correction value Ia stored in the correction value storage portion 58 is not updated at this time. Accordingly, the position detecting portion 51 uses the same upper limit value of the light emitting current as that in the case of measuring the position of the side face 311*a* of the conveyance belt 311 next time.

Exemplary effects of the present embodiment will be described. The inkjet recording apparatus 1 according to the present embodiment enables the position of the side face 311*a* of the conveyance belt 311 to be detected correctly, even when the light emitting portion 81 and/or the light receiving portion 82 are dirty, by performing correction for increasing the value of the light emitting current according to the dirtiness of the light emitting portion 81 and/or the light receiving portion 82. This will now be described in detail.

For example, ink may adhere to the light emitting portion 81 and/or the light receiving portion 82 when the inkjet recording apparatus 1 is used. Also, ink may also adhere to these portions in a state where there is dust adhering to the light emitting portion 81 and/or the light receiving portion 82. The light emitting portion 81 and/or the light receiving portion 82 could possibly become dirty due to factors such as these. When the light emitting portion 81 and/or the light receiving portion 82 become dirty, the amount of light that can be supplied to the light receiving portion 82 from the light emitting portion 81 decreases, causing the optical sensor 800 to not operate or to malfunction, as a result of which it may not be possible to correctly detect the position of the side face 311*a* of the conveyance belt 311.

In view of this, it is conceivable to periodically wipe off dirt on the light emitting portion 81 and/or the light receiving portion 82. However, because dirt adhering to the light emitting portion 81 and/or the light receiving portion 82 consists mainly of ink, it is difficult to completely remove the dirt even when the light emitting portion 81 and/or the light receiving portion 82 are wiped. Consequently, the dirtiness of the light emitting portion 81 and/or the light receiving portion 82 gradually becomes worse, due to the increase of the duration and frequency of use of the inkjet recording apparatus 1.

As described above, in step S1, the base current measurement portion 54 measure the value of the base current when a condition for correcting the value of the light emitting current (e.g., every 10,000 printed sheets) is satisfied. As described above, in step S4, the correction value determination portion 56 determines the correction value Ia of the light emitting current, so that the value of the light emitting current increases, according to the amount by which the measured value of the base current (measured value ia) increases relative to the initial value i0 of the base current. The amount of light required for detecting the position of the side face 311*a* of the conveyance belt 311 can thus be supplied to the light receiving portion 82, even when the light emitting portion 81 and/or the light receiving portion 82 are dirty.

As mentioned above, with the inkjet recording apparatus 1 according to the present embodiment, the light emitting current supplied to the light emitting portion 81 is initially set to a lower value than the upper limit value of the light emitting current, when detecting the position of the side face 311*a* of the conveyance belt 311 in order to correct skewing of the conveyance belt 311, and the value of the light emitting current can be gradually increased according to the dirtiness of the light emitting portion 81 and/or the light receiving portion 82. The amount of light required for detecting the position of the side face 311*a* of the conveyance belt 311 can thereby be supplied to the light receiving portion 82, even when the light emitting portion 81 and/or the light receiving portion 82 are dirty. Therefore, the precision of detection accuracy of the position of the side face 311*a* of the conveyance belt 311 can be improved, even when the light emitting portion 81 and/or the light receiving portion 82 of the optical sensor 800 are dirty.

If the light emitting current is set to a high value from the beginning (e.g., upper limit value of the light emitting current) and a large amount of light is irradiated by the light emitting portion 81, the amount of light received by the light receiving portion 82 can be increased above the value required for detecting the position of the side face 311*a* of the conveyance belt 311, even when the light emitting portion 81 and/or the light receiving portion 82 are dirty. However, in this case, the amount of light received by the light receiving portion 82 will greatly exceed the value required for detecting the position of the side face 311*a* of the conveyance belt 311, at a stage where the light emitting portion 81 and/or the light receiving portion 82 are not dirty or the degree of dirtiness is not significant. Therefore, a light emitting current of a higher value than necessary will be generated. With the inkjet recording apparatus 1 according to the present embodiment, the light emitting current supplied to the light emitting portion 81 is initially set to a low value, and can be gradually increased according to the dirtiness of the light emitting portion 81 and/or the light receiving portion 82, as mentioned above. Accordingly, this contributes to the energy saving of the inkjet recording apparatus 1, as compared with the case where the light emitting current is set to a high value from the beginning.

The present embodiment also can provide the following effects, for example. In the case of the base current measurement portion 54 measuring the base current, the belt moving mechanism 700 and the belt movement control unit 52, which are used for correcting skewing of the conveyance belt 311, are utilized to enable the conveyance belt 311 to not be positioned between the light emitting portion 81 and the light receiving portion 82, as described above, in step S2. Accordingly, a configuration for causing the conveyance belt 311 to not be positioned between the light emitting portion 81 and the light receiving portion 82 does not need to be provided separately.

Also, according to the present embodiment, in the case where the correction value Ia of the light emitting current determined by the correction value determination portion 56 exceeds the upper limit value stored in the upper limit value storage portion 59, a warning is displayed on the display panel 41, as described above, in step S7. Accordingly, the user can be informed of the need to replace the optical sensor 800.

Furthermore, according to the present embodiment, in the case where the correction value Ia of the light emitting current determined by the correction value determination portion 56 exceeds the upper limit value stored in the upper limit value storage portion 59, the position detection portion 51 detects the position of the side face 311*a* of the conveyance belt 311 after setting the value of the light emitting current generated by the current generation portion 900 to the upper limit value, as described above, in step S7. Accordingly, accidently damaging the light emitting portion 81 due to excessive current being supplied to the light emitting portion 81 can be prevented.

A modified example of the present embodiment will be described. In the present embodiment, the base current measurement portion 54, in the case where a condition for correcting the value of the light emitting current is satisfied, monitors the decrease in the value of the light receiving signal while decreasing the current generated by the current generation portion 900, in a state where the conveyance belt 311 is not positioned between the light emitting portion 81 and the light receiving portion 82, and measures the value of the base current, which is the current generated by the current generation portion 900, occurring at the point in time when the value of the light receiving signal reaches the reference value stored in the reference value storage portion 53. In contrast, in the modified example, the base current measurement portion 54, in a case where a condition for correcting the value of the light emitting current is satisfied, monitors the increase in the value of the light receiving signal while increasing the current generated by the current generation portion 900, in a state where the conveyance belt 311 is not positioned between the light emitting portion 81 and the light receiving portion 82, and measures the value of the base current, which is the current generated by the current generation portion 900, occurring at the point in time when the value of the light receiving signal exceeds the reference value stored in the reference value storage portion 53.

In the modified example, the way of measuring the value of the base current differs from that of the inkjet recording apparatus 1 according to the present embodiment. With the inkjet recording apparatus 1 according to the present embodiment, the decrease in the value of the light receiving signal is monitored while decreasing the current generated by the current generation portion 900, and the value of the base current, which is the current generated by the current generation portion 900, occurring at the point in time when the value of the light receiving signal reaches the reference value is measured. In the modified example, the increase in the value of the light receiving signal is monitored while increasing the current generated by the current generation portion 900, and the value of the base current, which is the current generated by the current generation portion 900, occurring at the point in time when the value of the light receiving signal exceeds the reference value is measured. That is, the base current measurement portion 54 monitors a change involving the increase in the value of the light receiving signal while changing the current generated by the current generation portion 900 by increasing the current, and measures the value of the base current, which is the current generated by the current generation portion 900, occurring at the point in time when the value of the light receiving signal exceeds the reference value.

The way of measuring the value of the base current is the only difference between the modified example described above and the inkjet recording apparatus 1 according to the present embodiment. The modified example may provide similar functional effects to the inkjet recording apparatus 1 according to the present embodiment.

In the present embodiment, the decrease in the value of the light receiving signal is monitored while decreasing the current generated by the current generation portion 900, and the value of the base current occurring at the point in time when the value of the light receiving signal reaches the reference value is measured. Also, in the modified example, the increase in the value of the light receiving signal is monitored while increasing the current generated by the current generation portion 900, and the value of the base current occurring at the point in time when the value of the light receiving signal exceeds the reference value is measured. This takes into consideration the case where 0 V is used as the reference value.

The following problems may arise when the reference value is set to 0 V in the case where the value of the light receiving signal does not fall below 0 V. If, in the case of monitoring the decrease in the value of the light receiving signal while decreasing the current generated by the current generation portion 900, the value of the base current were measured at the point in time when the value of the light receiving signal falls below the reference value, 0 V could not be used as the reference value. Similarly, if, in the case of monitoring the increase in the value of the light receiving signal while increasing the current generated by the current generation portion 900, the value of the base current were measured at the point in time when the value of the light receiving signal reaches the reference value, 0 V could not be used as the reference value.

Figure 11:
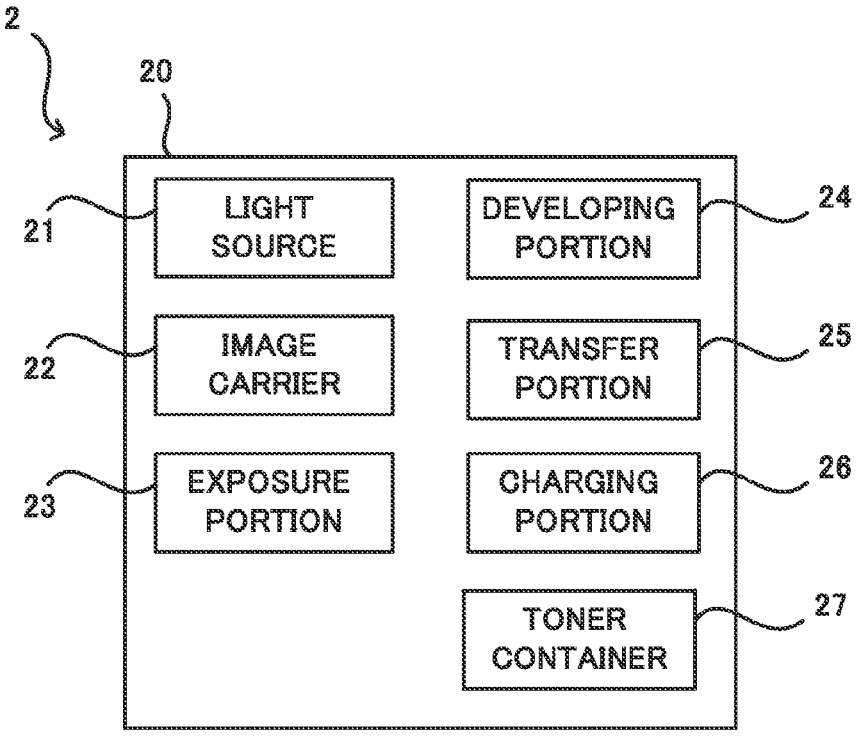
FIG. 11 is a schematic block diagram showing an image forming apparatus according to one embodiment of the present disclosure.

Although the inkjet recording apparatus 1 was described as an example of an image forming apparatus according to the present disclosure, the present disclosure is also applicable to other image forming apparatuses (e.g., image forming apparatus employing an electrophotographic method). For example, an image forming apparatus employing an electrophotographic method that is provided with an image forming portion that forms an image on paper and a conveyance belt 31 conveying paper is disclosed as another aspect of the present disclosure. In this case, an image forming apparatus 2, which is an exemplary image forming apparatus, is, as shown in FIG. 11, provided with an image forming portion 20 that includes a light source 21 that irradiates a light beam modulated according to image data, an image carrier 22, an exposure portion 23 that scans the image carrier 22 with the light beam irradiated from the light source 21 and forms an electrostatic latent image, a developing portion 24 that supplies toner to the image carrier 22 on which the electrostatic latent image was formed and forms a toner image, and a transfer portion 25 that transfers the toner image to paper. That is, the image forming apparatus 2 is provided with the image forming portion 20 instead of the recording portion 100 of the inkjet recording apparatus 1. Note that the image forming portion 20 further includes a charging portion 26 that charges the image carrier 22 and a detachable toner container 27 that supplies toner to the developing portion 24.

The light emitting portion 81 and/or the light receiving portion 82 may become dirty when the image forming apparatus 2 is used, due to toner adhering to the light emitting portion 81 and/or the light receiving portion 82. In particular, toner may splatter when the toner container 27 is attached or detached, and adhere to the light emitting portion 81 and/or the light receiving portion 82. When the light emitting portion 81 and/or the light receiving portion 82 become dirty, the amount of light that can be supplied to the light receiving portion 82 from the light emitting portion 81 decreases, causing the optical sensor 800 to not operate or to malfunction, as a result of which it may not be possible to correctly detection the position of the side face 311*a* of the conveyance belt 311. In contrast, with the image forming apparatus 2, the precision of measurement accuracy of the position of the side face 311*a* of the conveyance belt 311 can be improved even when the light emitting portion 81 and/or the light receiving portion 82 are dirty, by performing correction for increasing the value of the light emitting current depending on the dirtiness of the light emitting portion 81 and/or the light receiving portion 82, similarly to the inkjet recording apparatus 1.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a conveyance belt;

an image forming portion that forms an image on paper that is conveyed on the conveyance belt;

a belt moving mechanism that moves the conveyance belt in a width direction of the conveyance belt;

an optical sensor including a light emitting portion, and a light receiving portion in which a plurality of light receiving elements are aligned in the width direction of the conveyance belt, so that the number of light receiving elements that receive light irradiated by the light emitting portion differs depending on a position of a side face of the conveyance belt, the light receiving portion being configured to output a light receiving signal having a value that corresponds to the number of light receiving elements that receive light irradiated by the light emitting portion;

a current generation portion that generates an electric current that is supplied to the light emitting portion;

a position detection portion that causes the light emitting portion to emit light by causing the current generation portion to generate a light emitting current, which is the current supplied to the light emitting portion, when detecting the position of the side face of the conveyance belt, and detects the position of the side face of the conveyance belt based on the value of the light receiving signal output from the light receiving portion;

a belt movement control unit that moves the conveyance belt to correct skewing of the conveyance belt, by controlling the belt moving mechanism based on the position of the side face of the conveyance belt detected by the position detection portion;

a reference value storage portion storing in advance a reference value, which is the value of the light receiving signal output from the light receiving portion and is used as a reference when correcting a value of the light emitting current;

a base current measurement portion that, in a case where a condition for correcting the value of the light emitting current is satisfied, monitors a decrease in the value of the light receiving signal while decreasing the current generated by the current generation portion, in a state where the conveyance belt is not positioned between the light emitting portion and the light receiving portion, and, in a case where the value of the light receiving signal reaches the reference value stored in the reference value storage portion, measures a value of a base current, which is the current generated by the current generation portion;

an initial value storage portion storing in advance an initial value of the base current that is measured by the base current measurement portion; and a correction value determination portion that determines a correction value of the light emitting current, so that the value of the light emitting current increases, depending on an amount by which the value of the base current measured by the base current measurement portion increases relative to the initial value stored in the initial value storage portion, wherein the position detection portion, in a case of detecting the position of the side face of the conveyance belt after the correction value determination portion determines the correction value, utilizes the correction value determined by the correction value determination portion as the value of the light emitting current.

2. The image forming apparatus according to claim 1, wherein the image forming portion is a recording portion employing an inkjet method that records an image on the paper conveyed on the conveyance belt.

3. The image forming apparatus according to claim 1, wherein the belt movement control unit, in a case of the base current measurement portion measuring the base current, causes the conveyance belt to not be positioned between the light emitting portion and the light receiving portion, by controlling the belt moving mechanism to move the conveyance belt.

4. The image forming apparatus according to claim 1, comprising:

a display portion;

an upper limit value storage portion storing in advance an upper limit value of the light emitting current that is generated by the current generation portion; and a display control unit that displays a warning on the display portion, in a case where the correction value determined by the correction value determination portion exceeds the upper limit value stored in the upper limit value storage portion.

5. The image forming apparatus according to claim 4, wherein the position detection portion, in a case where the correction value determined by the correction value determination portion exceeds the upper limit value stored in the upper limit value storage portion, sets the value of the light emitting current that is generated by the current generation portion to the upper limit value, and detects the position of the side face of the conveyance belt.

6. The image forming apparatus according to claim 1, wherein the image forming portion includes a light source that irradiates a light beam modulated according to image data, an image carrier, an exposure portion that scans the image carrier with the light beam irradiated from the light source and forms an electrostatic latent image, a developing portion that supplies toner to the image carrier on which the electrostatic latent image is formed and forms a toner image, and a transfer portion that transfers the toner image to the paper.

7. An image forming apparatus comprising:

a conveyance belt;

an image forming portion that forms an image on paper that is conveyed on the conveyance belt;

a belt moving mechanism that moves the conveyance belt in a width direction of the conveyance belt;

an optical sensor including a light emitting portion; and a light receiving portion in which a plurality of light receiving elements are aligned in the width direction of the conveyance belt, so that the number of light receiving elements that receive light irradiated by the light emitting portion differs depending on a position of a side face of the conveyance belt, the light receiving portion being configured to output a light receiving signal having a value that corresponds to the number of light receiving elements that receive light irradiated by the light emitting portion;

a current generation portion that generates an electric current that is supplied to the light emitting portion;

a position detection portion that causes the light emitting portion to emit light by causing the current generation portion to generate a light emitting current, which is the current supplied to the light emitting portion, when detecting the position of the side face of the conveyance belt, and detects the position of the side face of the conveyance belt based on the value of the light receiving signal output from the light receiving portion;

a belt movement control unit that moves the conveyance belt to correct skewing of the conveyance belt, by controlling the belt moving mechanism based on the position of the side face of the conveyance belt detected by the position detection portion;

a reference value storage portion storing in advance a reference value, which is the value of the light receiving signal output from the light receiving portion and is used as a reference when correcting a value of the light emitting current;

a base current measurement portion that, in a case where a condition for correcting the value of the light emitting current is satisfied, monitors an increase in the value of the light receiving signal while increasing the current generated by the current generation portion, in a state where the conveyance belt is not positioned between the light emitting portion and the light receiving portion, and, in a case where the value of the light receiving signal exceeds the reference value stored in the reference value storage portion, measures a value of a base current, which is the current generated by the current generation portion;

an initial value storage portion storing in advance an initial value of the base current that is measured by the base current measurement portion; and a correction value determination portion that determines a correction value of the light emitting current, so that the value of the light emitting current increases, depending on an amount by which the value of the base current measured by the base current measurement portion increases relative to the initial value stored in the initial value storage portion, wherein the position detection portion, in a case of detecting the position of the side face of the conveyance belt after the correction value determination portion determines the correction value, utilizes the correction value determined by the correction value determination portion as the value of the light emitting current.

8. The image forming apparatus according to claim 7, wherein the image forming portion is a recording portion employing an inkjet method that records an image on the paper conveyed on the conveyance belt.

9. The image forming apparatus according to claim 7, wherein the belt movement control unit, in a case of the base current measurement portion measuring the base current, causes the conveyance belt to not be positioned between the light emitting portion and the light receiving portion, by controlling the belt moving mechanism to move the conveyance belt.

10. The image forming apparatus according to claim 7, comprising:

a display portion;

an upper limit value storage portion storing in advance an upper limit value of the light emitting current that is generated by the current generation portion; and a display control unit that displays a warning on the display portion, in a case where the correction value determined by the correction value determination portion exceeds the upper limit value stored in the upper limit value storage portion.

11. The image forming apparatus according to claim 10, wherein the position detection portion, in a case where the correction value determined by the correction value determination portion exceeds the upper limit value stored in the upper limit value storage portion, sets the value of the light emitting current that is generated by the current generation portion to the upper limit value, and detects the position of the side face of the conveyance belt.

12. The image forming apparatus according to claim 7, wherein the image forming portion includes a light source that irradiates a light beam modulated according to image data, an image carrier, an exposure portion that scans the image carrier with the light beam irradiated from the light source and forms an electrostatic latent image, a developing portion that supplies toner to the image carrier on which the electrostatic latent image is formed and forms a toner image, and a transfer portion that transfers the toner image to the paper.

* * * * *